US007002613B2

(12) United States Patent
Beier et al.

(10) Patent No.: US 7,002,613 B2
(45) Date of Patent: Feb. 21, 2006

(54) METHOD FOR PRINTING AN IMAGE ON A PRINTING SUBSTRATE AND DEVICE FOR INPUTTING ENERGY TO A PRINTING-INK CARRIER

(75) Inventors: Bernard Beier, Ladenburg (DE); Bernd Vosseler, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 117 days.

(21) Appl. No.: 10/463,916

(22) Filed: Jun. 18, 2003

(65) Prior Publication Data

US 2004/0046860 A1 Mar. 11, 2004

(30) Foreign Application Priority Data

Sep. 6, 2002 (DE) ..... 102 41 911

(51) Int. Cl.
*B41J 2/447* (2006.01)
*B41J 2/45* (2006.01)

(52) U.S. Cl. ..... 347/238

(58) Field of Classification Search ..... 347/224, 347/233, 238, 171
See application file for complete search history.

(56) References Cited

U.S. PATENT DOCUMENTS

| | | | | |
|---|---|---|---|---|
| 4,743,920 A | * | 5/1988 | Tohma et al. | 347/171 |
| 5,477,259 A | | 12/1995 | Iwasa | 347/238 |
| 5,838,715 A | | 11/1998 | Corzine et al. | 372/96 |
| 5,940,113 A | * | 8/1999 | Wilson | 347/238 |
| 6,198,497 B1 | | 3/2001 | Luque | 347/247 |
| 2002/0000190 A1 | | 1/2002 | Neuhaus | 118/231 |

FOREIGN PATENT DOCUMENTS

| | | | |
|---|---|---|---|
| DE | 3625592 | | 2/1987 |
| DE | 4205636 | | 8/1993 |
| DE | 1954099 | | 5/1997 |
| DE | 19602307 | | 7/1997 |
| DE | 69808183 | | 9/1998 |
| DE | 19746174 | | 7/1999 |
| DE | 10117711 | | 11/2001 |
| EP | 0718720 | * | 6/1996 |
| EP | 0905835 | | 3/1999 |

(Continued)

OTHER PUBLICATIONS

K. J. Ebeling, Integrierte Optoelektronik, 2. Auflage Springer Verlag, Berlin Heidelberg New York, pp. 374-376.

*Primary Examiner*—Huan Tran
(74) *Attorney, Agent, or Firm*—Davidson, Davidson & Kappel, LLC

(57) ABSTRACT

A method for printing an image on a printing substrate, a number of portions of fluid printing ink being produced on a printing ink carrier (10) through energy input by a number of image spots (810) of an array (84) of individually controllable VCSEL light sources, and the fluid printing ink being transferred to the printing substrate. A device for inputting energy (80) to a printing-ink carrier (10), includes a number (82) of individually controllable laser light sources which have a modular design consisting of subarrays (86) and are disposed in an array (84), and further includes printing-ink carrier (10) with which is associated an axis of rotation (88) and on the surface of which can be produced a number of image spots (810) of the laser light sources. The subarrays of laser light sources are VCSEL bars (84), and rows of image spots (12) of the VCSEL bars are inclined with respect to the axis of rotation (88).

19 Claims, 6 Drawing Sheets

FOREIGN PATENT DOCUMENTS

| | | | | |
|---|---|---|---|---|
| EP | 0947324 | 10/1999 | | |
| EP | 0887193 | 9/2002 | | |
| GB | 2178698 | 2/1987 | | |
| JP | 5-69591 | * 3/1993 | ..... | 347/238 |
| WO | 0012317 | 3/2000 | | |
| WO | 0040423 | 7/2000 | | |

* cited by examiner

METHOD FOR PRINTING AN IMAGE ON A PRINTING SUBSTRATE AND DEVICE FOR INPUTTING ENERGY TO A PRINTING-INK CARRIER

Priority to German Patent Application No. 102 41 911.6, filed Sep. 6, 2002 and hereby incorporated by reference herein, is claimed.

BACKGROUND INFORMATION

The present invention relates to a method for printing an image on a printing substrate, a number of portions of fluid printing ink being produced on a printing-ink carrier by inputting energy, and the fluid printing ink being transferred to the printing substrate. Moreover, the present invention relates to a device for inputting energy to a printing-ink carrier, including a number of individually controllable laser light sources which have a modular design consisting of subarrays and are disposed in an array, and further including a printing-ink carrier with which is associated an axis of rotation and on the surface of which can be produced a number of image spots of the laser light sources.

Digital or variable printing methods are printing methods that allow different contents or subjects to be transferred to a printing substrate from copy to copy or from print to print. Generally known digital printing methods are, for example, electrophotography or ink jet printing. Besides, however, there are also approaches to transfer images, texts, subjects or the like, to printing substrates in a variable manner using fluid printing inks, also liquid pigmented printing inks. Some approaches of that kind have already been documented in detail in the literature.

For example, German Patent No. 42 05 636 C2 describes a method and a device for variable printing by means of which meltable printing inks are applied to a printing-form carrier, such as a cylinder, and in which printing ink that is solid at room temperature and meltable through the addition of heat is applied to the printing-form carrier as a continuous viscous film and subsequently solidified there by cooling. The solidified film is then exposed to the radiation of a laser or of a laser line on a dot-by-dot or pixel-by-pixel basis, the printing inks being liquefied in the irradiated regions and, while still in the liquid state, transferred to a printing substrate where they cool down again.

Moreover, German Patent Application No. 36 25 592 A1 describes a variable printing method, a so-called "heat transfer recording method". In this context, a printing ink exhibiting delayed solidification is applied to and solidified on a cylinder as the printing-ink carrier, or the cylinder itself is composed of solid printing ink. After that, the solid ink located on the cylinder is locally softened by energy radiation, for example, of a laser. The softened spots can then be transferred to a printing substrate. After the transferal, the remaining ink layer is scraped off in a thickness which corresponds to the layer thickness that has been transferred to the print carrier.

Another variable printing method, a so-called "suction pressure method" is described in PCT Patent Application No. WO 00/40423. A printing-ink carrier features depressions as the printing regions, whereas non-printing regions are at a constant level. Prior to printing, the entire surface of the printing-ink carrier is inked, that is, flooded with ink, as follows: Prior to receiving printing ink, the air located in the depressions is selectively heated in a controlled manner, expelling it from the depressions due to the strong temperature dependence of its volume. When the entries to the depressions are then closed by the printing ink and the remaining air in the depressions is subsequently cooled, then the air will contract as it cools, thus suctioning printing ink into the depressions. The greater the temperature variation in the depressions, the stronger is this effect. By controlling the temperature in the depressions, it is, in principle, possible to control the received quantity of printing ink. Prior to each new printing cycle, the printing-ink carrier can be imaged anew or differently by means of a thermal image, that is, by selectively radiating energy into the depressions. Prior to transferring the printing ink to a printing substrate, the printing ink is removed from the non-printing regions using a wiper, a doctor blade, or the like, thus leaving printing ink only in the depressions. Ink transfer from the depressions to the printing substrate is accomplished by high contact pressure and the adhesion forces between the printing substrate and the ink.

European Patent Application No. 0 947 324 A1 discloses a printing method and an associated device. Using the light-hydraulic effect, pressure pulses are introduced into an ink layer on a printing-ink carrier by means of a laser light source in such a manner that a portion of printing ink is detached and transferred to a printing substrate.

Another variable printing method and a device for carrying out the method are described in German Patent No. 197 46 174 C1. A printing-form carrier is provided with depressions which can be filled with printing ink. A number of portions of printing ink are selected or produced through the action of a digitally controlled energy beam. The ink transfer takes place due to adhesion forces when the printing ink that is expelled from a depression contacts a printing substrate.

All these approaches have the common requirement that in order to produce an image spot, a certain amount of energy must, if possible, be coupled into a narrowly defined spatial region of a printing-ink carrier that is correlated with the printing dot to be produced, possibly in a contact-free manner. The energy form used here is mostly laser light in the ultraviolet, visible, or infrared spectral ranges because of the high spectral power density, directionality and other properties. Since all individual spots of an image to be printed must be produced during imaging with preferably as short a duration as possible, the total power of the required energy source is relatively high.

To image a two-dimensional surface of a printing substrate in a variable printing method, the printing substrate is usually moved relative to the image-producing device in one of the directions defining the surface while the image is being produced. In principle, a relative movement in the second unfolding direction, a so-called "scanning", can be carried out as well. Alternatively, the image can be produced temporally and spatially parallel over the entire width of the image, which is also referred to as "page-wide".

A clear disadvantage of scanning is the fact that only a limited maximum speed is achievable. An exact synchronization of the movements of the deflecting mirror and of the paper transport at extremely different speeds can only be achieved with great effort; for example, it is required to use piezoelectric mirrors. As a rule, a large installation space is needed. If only a small amount of time is available for each energy input, the energy must be coupled in rapidly, which requires a high power density of the laser light source. The risk of damage to optical components increases, but also the possibility of an unwanted modification of involved materials, such as the printing ink itself. The high power density must be modulated very rapidly. For a page width of 34 cm, 600 dpi, and a printing speed of 1 m/s, over 200 MHz are required. Through the use of a plurality of laser light sources, such as a line of laser light sources, the requirements in terms of power, modulation frequency, and scanning speed are, in fact, reduced, but the coupling-in of two light beams into a polygon scanner is technically already very difficult to implement. For example, fifty light beams, each modulated at 4 MHz, are to be considered extremely difficult.

Page-wide arrays or arrangements of light-emitting diodes (LED), as are widespread, for example, in electrophotographic printing presses, can produce only several milliwatts of optical power in a region of 40 micrometers ×40 micrometers, the size of a printing dot at 600 dpi, due to their unfavorable radiation characteristic. This optical power is insufficient for most of the variable printing methods. Moreover, due to the always low quantum efficiency, a multiple of the optical power must be dissipated as waste thermal power. Increasing the efficiency by special geometries or using cavity LEDs has not helped so far either.

In the context of variable printing methods, it is also known, for example, from PCT Patent Application No. WO 00/12317 to use page-wide arrays or arrangements of fibers or optical waveguides by means of which light is conducted from one or more remote light sources, typically a laser light source, to a printing-ink carrier. Due to the required high positional accuracy over very long periods of time, the positioning effort for such an arrangement of fibers is very high. The assignment of the individual channels during assembly requires considerable effort. Moreover, the cost of a fiber coupling of a laser and of the required optical waveguide length in the range of several meters that is needed for each channel for the connection between the laser and the printing press is so high that a device for inputting energy to a printing-ink carrier in a digital printing press would be uneconomical.

SUMMARY OF THE INVENTION

Considering the disadvantages of the prior art, it is an object of the present invention to provide a method for printing an image on a printing substrate, including a powerful energy source, and a device for inputting energy to a printing-ink carrier. In particular, a device for inputting energy is intended to be equipped with a separate light source for each line to be imaged and to be able to write lines densely. The device is also intended to have a high output power and sufficient resolution and depth of focus. Moreover, the device is intended to be comparatively inexpensive to manufacture and maintain and to have a high reliability.

According to the present invention, in a method for printing an image (or a text or subject) on a printing substrate, a number of portions of fluid printing ink are produced on a printing-ink carrier by inputting energy. An energy input is produced on the printing-ink carrier by a number of image spots of an array of individually controllable VCSEL light sources. The fluid printing ink is transferred to the printing substrate. In particular, the fluid printing ink can be liquid.

A portion of fluid printing ink is the amount of printing ink which produces an image spot and has a suitable viscosity to be absorbed on and/or in the printing substrate.

The array of VCSEL light sources can, in particular, be a VCSEL bar having a number of individually controllable VCSEL light sources or an arrangement of a number of such VCSEL bars. A plurality of image spots can be produced on the printing-ink carrier simultaneously and/or spatially parallel. The method according to the present invention can also be referred to as a variable or digital method for printing. In particular, a temporary or transient intermediate image of fluid printing ink can be produced on the printing-ink carrier by inputting energy. The printing-ink carrier can be an intermediate image carrier. In this situation, the printing ink of the temporary intermediate image is transferred to the image carrier by impression. Typical printing substrates are paper, cardboard, paperboard, organic polymer film, or the like. Printing substrates can also be referred to as image carriers.

In other words, in the context of the inventive idea, an array of individually controllable VCSEL light sources, in particular, VCSEL bars, is used or employed in a variable or digital printing method.

While conventional semiconductor lasers are edge emitters, i.e., the light propagates perpendicular to the surface of the pn junction and emerges from the gap surfaces of the chip in a perpendicular direction, surface-emitting laser diodes (VCSEL light sources, VCSEL laser diodes, vertical cavity surface emitting lasers) emit light perpendicular to the wafer surface. The resonator axis is parallel to the area of the pn junction. In the context of this description of the method and device according to the present invention, the term "VCSEL light source" can be understood to mean all diode lasers whose emission direction is perpendicular to the active zone. These can be, in particular, surface emitters whose resonator length is short compared to the thickness of the active zone, surface emitters whose resonators are extended monolithically, or surface emitters having an external or a coupled resonator (also referred to as NECSELs). Moreover, a VCSEL light source can be a diode laser whose resonator is essentially parallel to the active zone and is provided with a diffracting or reflecting structure which couples out the laser radiation perpendicular to the active zone.

The functionality and a number of properties of a VCSEL light source can be tested already on the wafer or immediately after manufacture. Due to the extended emitter surface, the radiation is emitted with a small divergence angle, in particular, compared to conventional edge-emitting semiconductor lasers. It generally applies to VCSEL light sources that the active length of the resonator can be very short, typically only several micrometers, and that highly reflecting resonator mirrors are required in order to obtain low threshold currents. The required mirrors can be grown epitaxially. Using an extremely short resonator, often below a length of 10 micrometers, a large longitudinal mode distance is achieved, which promotes single-mode emission above the laser threshold. However, single-mode emission is not necessarily required in the context of the inventive idea because multi-mode VCSEL light sources can be used as well. Using a rotationally symmetric resonator, a circular near-field is obtained, as well as a small beam divergence due to the relatively large diameter. The beam quality and the shape of the emitted light beam are largely determined by the size of the output facet. By selecting the proper size (diameter limitation), a VCSEL generates the fundamental mode (Gaussian beam), which, due to the high depth of focus, is advantageous for a controlled energy input for imaging. For high optical output power, larger output facet diameters can be advantageous. Moreover, the design of the laser allows simple monolithical integration of two-dimensional arrays of VCSEL laser diodes. Finally, it is possible to test the lasers directly on the wafer disk after manufacture.

The typical layered structure of a surface-emitting laser is known to one skilled in the art and can be gathered from relevant literature. In this respect, see, for instance, K. J. Ebeling "Integrierte Optoelektronik" [Integrated Optoelectronics], Springer Publishing House, Berlin, 1992. This document is incorporated into this disclosure by reference. Arrays of VCSEL light sources can be manufactured as two-dimensional arrangements. For example, European Patent Application No. 0 905 835 A1 describes a two-dimensional array of VCSEL light sources which can be addressed or controlled individually. To increase the achievable output power and to force the laser to oscillate in the fundamental mode, U.S. Pat. No. 5,838,715 discloses a special resonator shape for a VCSEL layer structure.

For a resolution of 600 dpi, a typical resolution in variable printing methods, lasers having a beam quality inferior to diffraction-limited quality are already sufficient. VCSELs having 90 mW of output power can be focused to 40 micrometers ×40 micrometers (which corresponds to 600 dpi). The luminous intensity on the exit facet of a VCSEL is only a fraction of that occurring on the exit surface of an edge-emitting semiconductor laser, so that the risk of facet destruction is reduced. The reliability of VCSEL light sources compared to edge-emitting semiconductor lasers is, in principle, much higher. The increased reliability is particularly advantageous if the intention is for a device for inputting energy to a printing-ink carrier to be used in a printing method using a plurality of light sources.

In a preferred embodiment of the inventive method for printing an image on a printing substrate, the number of portions of fluid printing ink are produced by melting or softening solid printing ink on the printing-ink carrier on a dot-by-dot basis. In a special embodiment, the printing ink can exhibit delayed solidification during cooling. In other words, the melting point is at a higher temperature than the solid point. Due to the solidification delay, the printing ink remains in the liquid state until it is printed on the printing substrate by contact.

In an alternative embodiment of the printing method according to the present invention, the number of portions are produced by suctioning fluid printing ink into depressions on a dot-by-dot basis upon cooling of the volumes of the depressions that were heated by the energy input. Subsequently, the fluid printing ink is printed on the printing substrate. In other words, the printing method includes steps of a suction pressure method.

In a further embodiment of the printing method according to the present invention, the number of portions of fluid printing ink are produced by detachment from a layer of printing ink. The portions of fluid printing ink are transferred to the printing substrate due to the energy input in a contact-free manner. In other words, the further embodiment of the method according to the present invention uses the light-hydraulic effect.

In another alternative embodiment of the printing method, the number of portions of fluid printing ink are produced by expelling from depressions in the printing-ink carrier. The portions of fluid printing ink are transferred to the printing substrate upon contact (preferred) or in a contact-free manner.

Also related to the inventive idea is a device according to the present invention for inputting energy to a printing-ink carrier, including a number of individually controllable laser light sources which have a modular design consisting of subarrays and are disposed in an array, and further including a printing-ink carrier with which is associated an axis of rotation, and on the surface of which can be produced a number of image spots of the laser light sources. The subarrays of laser light sources are VCSEL bars. The VCSEL bars can be accommodated on imaging modules. In the case of simultaneous triggering (when the light sources are switched on simultaneously), rows, i.e., lines and/or columns, of image spots of the VCSEL bars are located on the printing-ink carried such that they are inclined with respect to the axis of rotation.

At this point, it should be mentioned that it is known from the literature, such as from U.S. Pat. No. 5,477,259, that an array of light sources can be made up of individual modules of subarrays. These are typically rows, that is, one-dimensionally arranged laser diodes which are fixed to a holding element side-by-side, forming a two-dimensional array of light sources. The array of light sources disclosed in U.S. Pat. No. 5,477,259 is located on the intersection points of a parallelogram grid.

In particular, the printing-ink carrier can be an intermediate image carrier. The array can be regular and/or one-dimensional or two-dimensional (preferred), preferably Cartesian. It is particularly advantageous if the laser light sources on the VCSEL bars are arranged on the intersection points of a regular Cartesian, two-dimensional grid, so that an inclination with respect to the axis of rotation has a uniform effect on all light sources. It is also worth mentioning that in a two-dimensional arrangement, it is possible to leave larger spaces between the individual VCSEL light sources, channels and emitted light beams, so that collimation is simplified. Unlike edge-emitting semiconductor lasers, the beam diameter and the divergence angle of a VCSEL light source in both lateral directions perpendicular to the propagation direction of the emitted light are equal, so that collimation and focusing can be accomplished using relatively simple optics arranged downstream, such as microlens arrays, in particular, a microlens for one or more emitted light beams.

In a preferred embodiment of the device according to the present invention for inputting energy to a printing-ink carrier, the inclination angle between the unfolding direction of the row of image spots of the VCSEL bars and the axis of rotation or the complementary angle of the inclination angle is selected such that the projected spots of the image spots on a line parallel to the axis of rotation have even spaces between neighboring spots.

For a two-dimensional, regular Cartesian arrangement of n×m image spots, with the direction in which the n image spots are located having an inclination angle $\alpha$ with the perpendicular to the axis of rotation, it applies that a row of projected image spots has regular or even spaces between neighboring spots if $\tan \alpha = 1/n$. If the two-dimensional arrangement is Cartesian, but has a spacing a of neighboring image spots in the direction of the n image spots, as well as a spacing b of neighboring image spots in the direction of the m image spots, then it applies that $\tan \alpha = b/na$.

In a further development of the device according to the present invention, the printing-ink carrier is illuminated by the laser light sources from its underside. In other words, the printing-ink carrier can be transparent so that the laser light can penetrate it up to the printing ink, or the printing-ink carrier is designed in such a manner that it is able to absorb the energy of the laser light at least partially and impart it to the printing ink.

In an advantageous embodiment of the inventive device for inputting energy, the VCSEL bars are staggered in at least two substantially parallel rows.

In alternative embodiments, the VCSEL bars feature top emitters ((p-side up emitters, p-doped layer up) or bottom emitters (p-side down emitter, p-doped layer down). In other words, in a p-side up embodiment of the inventive device for inputting energy, the light emission occurs at the top side of the device whereas in a p-side down embodiment, the laser radiation used for inputting energy can be emitted through the semiconductor substrate of at least one VCSEL bar of the number of VCSEL bars, preferably all VCSEL bars. In addition or as an alternative to this, in one embodiment of the inventive device for inputting energy, at least one VCSEL bar can include at least one drive electronics of which at least a part is accommodated on the substrate or the wafer of the VCSEL bar and/or of which at least a part is accommodated on a common heat sink together with the VCSEL bar and/or have a common cooling circuit. In addition or as an alternative to this, in one embodiment of the device according to the present invention, at least one VCSEL bar, preferably all VCSEL bars, and a part of its drive electronics can be made from one substrate or on one substrate or from one wafer or on one wafer. In particular, in one embodiment, at least one VCSEL bar, preferably all VCSEL bars, can be accommodated on a surface containing diamond and/or aluminum nitride. In addition or as an alternative to this, in one embodiment, at least one VCSEL bar can be contacted with conductor tracks from two sides. In addition or as an alternative to this, in one embodiment of the inventive device for inputting energy, at least one VCSEL bar, preferably all VCSEL bars, can be deposited on a surface in which or on which conductor tracks for controlling the individual light sources are accommodated. The separately described measures, alone or in cooperation with each other, advantageously permit a compact design of the array of light sources.

A particularly preferred embodiment of the inventive device for inputting energy to a printing-ink carrier features a page-wide array of VCSEL bars. In this context, the projected spots of the image spots on a line parallel to the axis of rotation are dense, which means that the spacing of the imaging spots corresponds to the minimum printing dot spacing or screen ruling of the image, which makes it possible to produce solid areas. In other words, using the special embodiment of the device according to the present invention, it is possible to write, image or place page-wide rows of dense image spots on the printing-form carrier so that a number of portions of fluid printing ink are densely produced over the width of a page.

Embodiments of the inventive device and/or improvements thereof can be employed or used in a particularly advantageous manner in the inventive method and/or improvements thereof described in this specification, in particular, in the specific embodiments addressed in this specification. In other words, a method according to the present invention for printing an image on a printing substrate can be characterized by the generation of an energy input using a device according to the present invention.

Also related to the inventive idea is a printing press that works using a printing method according to the present invention. In particular, depending on the specific embodiment of the inventive method, the printing press can be referred to as a gravure printing press or a planographic printing press. The printing press can be a web-fed press or a sheet-fed press (preferred), in particular, a perfecting press. The printing press can have one or more printing units. In other words, a printing unit or a printing press according to the present invention feature at least one inventive device for inputting energy to a printing-ink carrier.

BRIEF DESCRIPTION OF THE DRAWINGS

Further advantages as well as expedient embodiments and refinements of the present invention will be depicted by way of the following Figures and the descriptions thereof. Specifically.

DETAILED DESCRIPTION

Figure 1A:
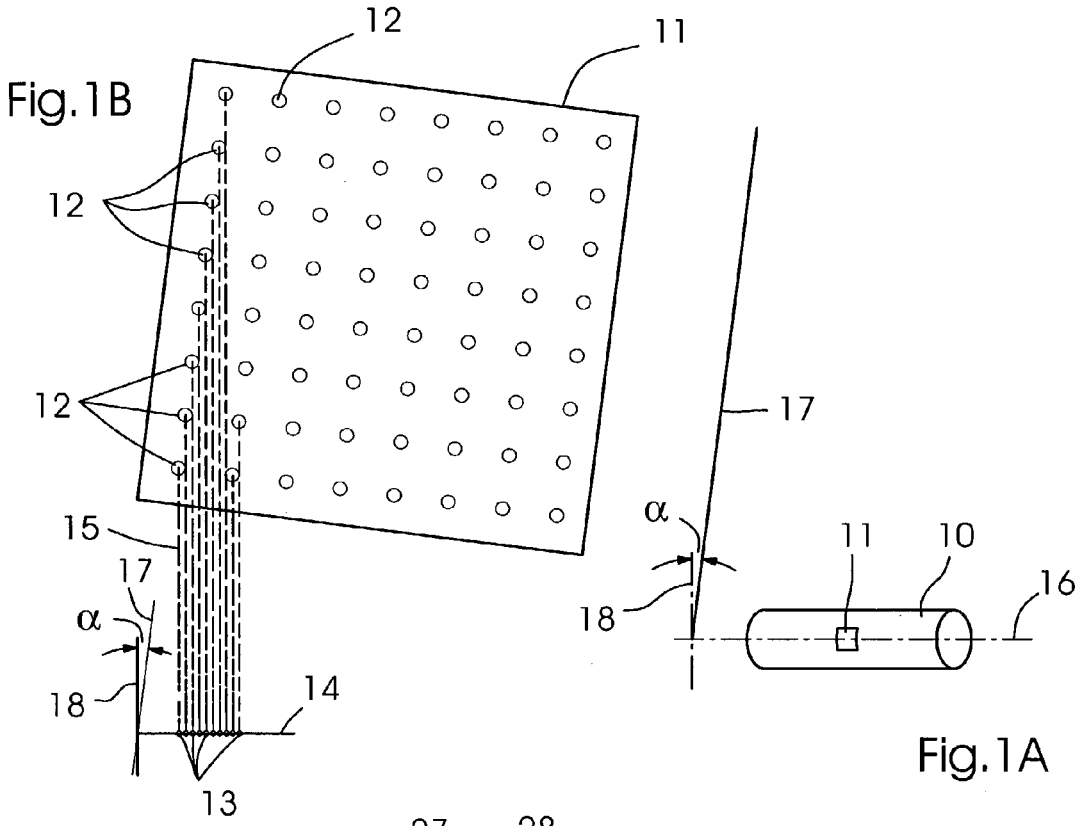
FIG. 1 is a diagram to illustrate the relative position of the number of image spots on a printing-ink carrier in the inventive device for inputting energy to a printing-ink carrier (Subfigures 1A and 1B)

In FIG. 1, the relative position of the number of image spots 12 on a printing-ink carrier 10 in the inventive device for inputting energy to a printing-ink carrier 10 is shown in Subfigures 1A and 1B) for the purpose of illustration. Subfigure 1A of FIG. 1 depicts an advantageous embodiment of a printing-ink carrier 10. Printing-ink carrier 10 is a cylinder body, represents the lateral surface of a cylinder partially or in its entirety, or is held on a cylinder. Printing-ink carrier 10 is designed such that it can rotate about an axis of rotation 16. Segment 11 of the surface of printing-ink carrier 10 is the region where image spots of a VCSEL bar come to rest when triggered simultaneously. The image spots are regularly arranged on intersection points of a Cartesian grid. The axes defining the grid are rotated by inclination angle $\alpha$ with respect to axis of rotation 16 and to the normal (perpendicular) 18 to the axis of rotation: unfolding direction 17 and normal 18 form inclination angle $\alpha$.

Subfigure 1B of FIG. 1 shows an enlarged detail of Subfigure 1A. Subfigure 1B shows segment 11 of the surface of printing-ink carrier 10 including a number of image spots 12 in a regular and Cartesian arrangement for the case that the VCSEL light sources are triggered or tripped simultaneously. Rows of image spots 12 located along an unfolding direction 17 are projected onto a line 14 by delayed or advanced triggering or tripping of the VCSEL light sources if the imaging beams producing the image spots, in particular, the light sources, and the surface of the printing-ink carrier move relative to each other. If line 14 is parallel to axis of rotation 16 and forms an inclination angle $\alpha$ with an unfolding line of the Cartesian grid of n×m image spots 12 (n image spots along unfolding line 17), the projected spots 13 of image spots 12 are dense, that is, they have the minimum printing dot spacing, if the condition $\tan \alpha = 1/n$ is fulfilled.

Figure 2:
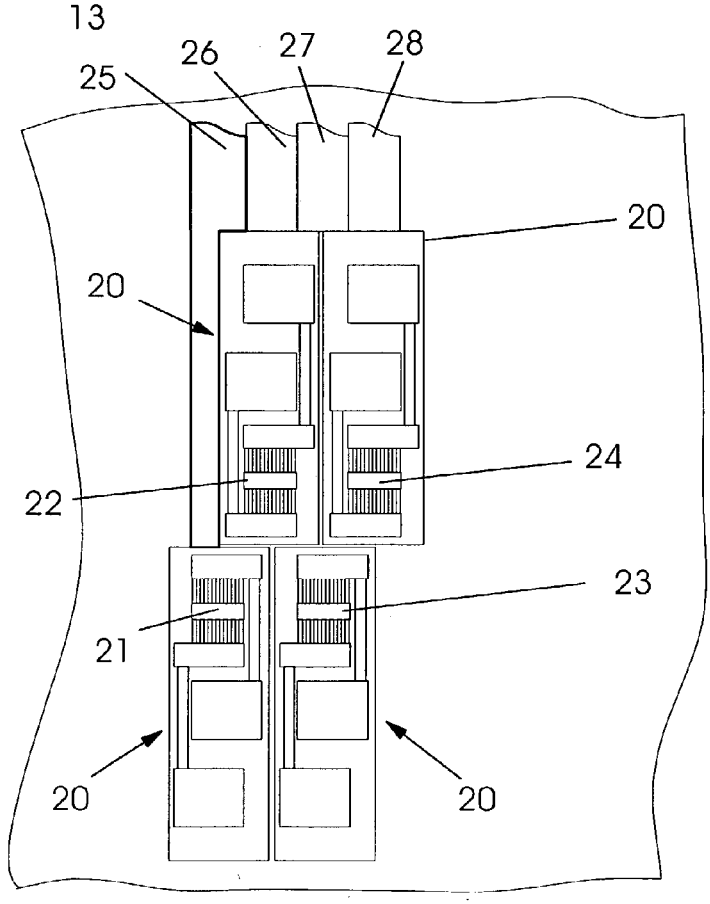
FIG. 2 shows an advantageous embodiment of the arrangement of imaging modules in the device according to the present invention for inputting energy to a printing-ink carrier.

FIG. 2 shows an advantageous embodiment of the arrangement of imaging modules 20 in the device according to the present invention for inputting energy to a printing-ink carrier. An array of VCSEL light sources can be made up of such imaging modules 20. In the embodiment shown in FIG. 2, an imaging module carries a VCSEL bar which, by way of example, has 256 VCSEL light sources or emitters. The geometry of the emitters in the VCSEL bar is, by way of example, 32×8 emitters, in a regular and Cartesian arrangement, that is, in a rectangular raster or on a rectangular grid, with a spacing of 320 micrometers between the centers of neighboring light sources. For a format size of 34 centimeters and an image spot size of 40 micrometers, 34 VCSEL bars each with 256 VCSEL light sources are required. Preferred are numbers of light sources on a VCSEL bar that are powers of 2. The imaging modules, that is, the VCSEL bars or subarrays, are arranged inclined with respect to the axis of rotation of a cylindrical printing-ink carrier in such a manner that the projected spots of the image spots of the emitters are evenly spaced on the lateral surface of the printing-ink carrier (in this respect, see also FIG. 1).

In the embodiment with bottom emitters, the emitters are contacted via conductor tracks that are provided in an electrically insulating substrate, such as a diamond substrate. In the case of bottom emitters, it is advantageously avoided that a number of bonding wires are arranged on the light exit side which could possibly hinder the exit of light. If the n-doped side of the light source is up and the p-doped side of the light source is down, then the substrate surface opposite the p-doped side must be patterned. The substrate itself is attached to a heat sink, preferably to a patterned heat sink, such as a microchannel cooler, so that adequate and efficient heat transfer is provided between the substrate and the heat sink. In this embodiment, the current sources for the VCSEL light sources are situated in the immediate vicinity of the light sources on one or more semiconductor components which can be attached to or accommodated on the same substrate as the VCSELs, or which can be attached to or accommodated on a separate substrate on the same or a different heat sink.

The beam shaping of the laser light emerging from the emitters can be accomplished using micro-optical components (acting on only one or more light beams of the VCSEL bar) and/or macro-optical components (acting on all light beams of the VCSEL bar). Suitable for beamshaping are, in particular, arrays of micro-optical components, such as microlens arrays, where the spacing between the individual components corresponds to the spacing of two laser emitters or a multiple thereof.

Since two neighboring imaging modules 20 or neighboring VCSEL bars cannot be placed close enough to write neighboring lines densely (at 600 dpi 40 micrometers), the two-row arrangement shown in FIG. 2 is particularly advantageous. Preferred is an arrangement in two rows, where the distance of the VCSEL bars of two neighboring imaging modules 20 in the circumferential direction of the cylindrical printing-ink carrier is as small as possible. Imaging modules 20 which are shown in FIG. 2 and include first VCSEL bar 21, second VCSEL bar 22, third VCSEL bar 23, and fourth VCSEL bar 24 image strips which are located on printing-ink carrier 10 densely side-by-side: first strip 25 is imaged by first VCSEL bar 21, second strip 26 by second VCSEL bar 22, third strip 27 by third VCSEL bar 23, and fourth strip 28 is imaged by fourth VCSEL bar 24.

Figure 3:
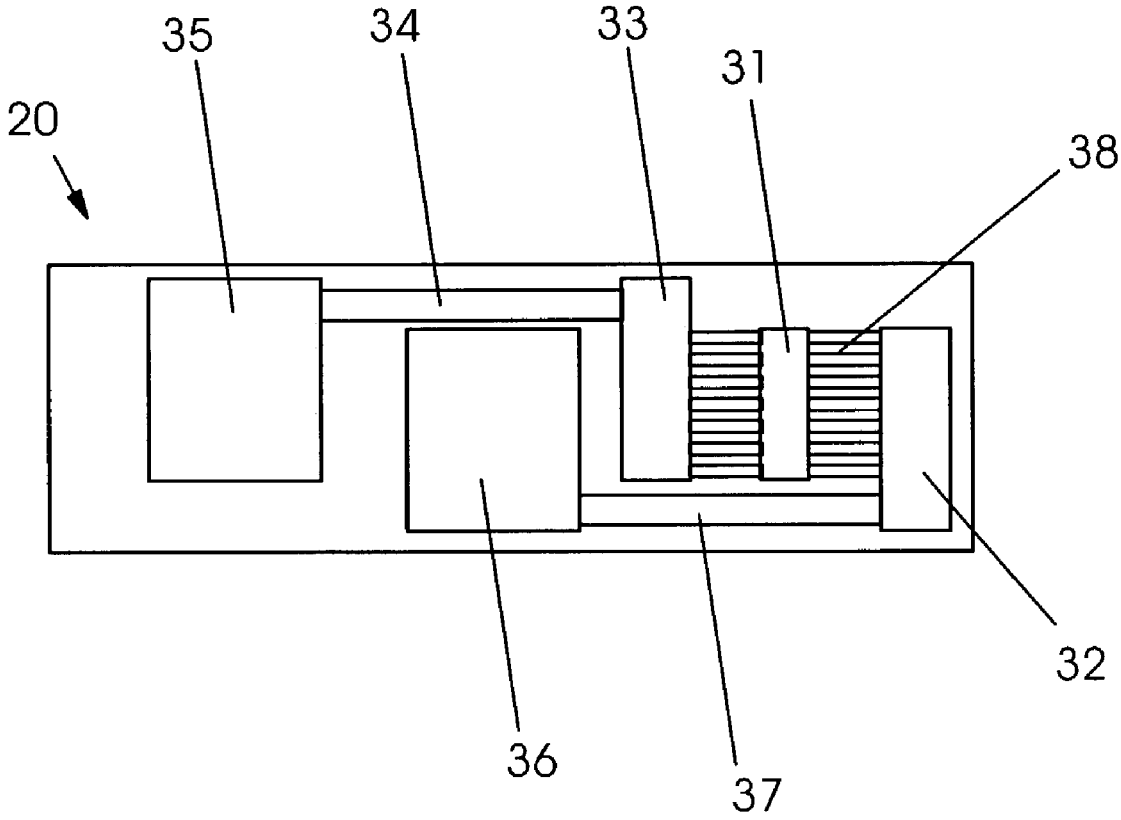
FIG. 3 depicts an advantageous embodiment of imaging modules in the device according to the present invention.

FIG. 3 schematically relates to an advantageous embodiment of imaging modules 20 in the device according to the present invention. A difficulty in supplying power to a two-dimensional arrangement of VCSEL light sources on one bar is to lead through the conductor tracks narrowly enough between the emitters of the rows at the edge. Here, it is advantageous for the feed lines for one half of the emitters to come from one direction and for the other half of the emitters to come from the other direction. FIG. 3 serves to illustrate this advantageous geometry or configuration in greater detail. FIG. 3 shows the design of one embodiment of an imaging module 20 having a VCSEL bar 31. VCSEL bar 31 is connected to first drive electronics 32 (driver chip) for a first half of the number of VCSEL light sources on the bar and second drive electronics 33 (driver chip) for a second half of the number of VCSEL light sources on the bar. First drive electronics 32 is interactively connected to a first electronics boards 36 via a first connecting line 37. Second drive electronics 33 is interactively connected to a second electronics boards 35 via a second connecting line 34. First and second electronics boards 35, 36 are provided with the required terminals, power supply, and clock generation for driving the light sources. First and second drive electronics 32, 33 are connected to the VCSEL light sources on VCSEL bar 31 via parallel conductor tracks 38. Conductor tracks 38 contact the VCSEL bar from two sides.

Figure 4:
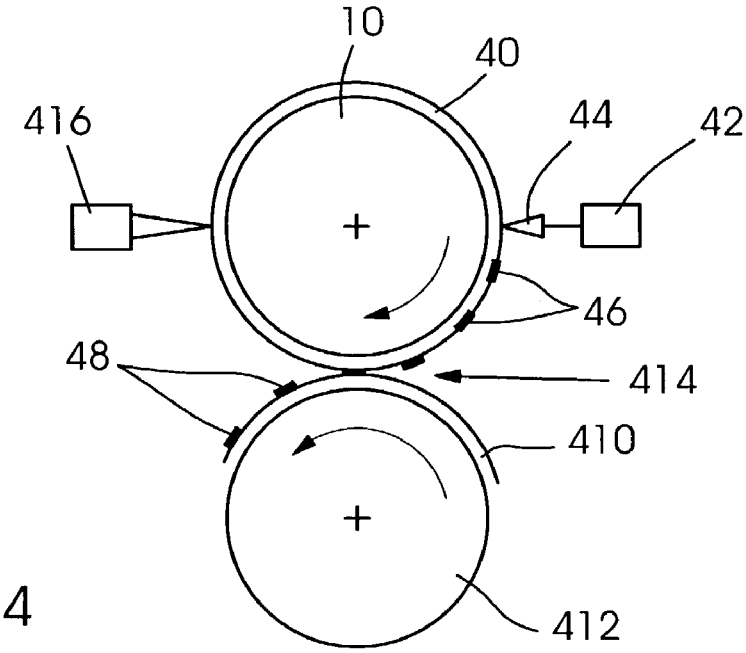
FIG. 4 is a schematic diagram to illustrate an embodiment of the method according to the present invention for printing an image on a printing substrate, the number of portions of fluid printing ink being produced by melting solid printing ink, which is located on the printing-ink carrier and exhibits delayed solidification, on a dot-by-dot basis.

FIG. 4 is a schematic diagram to illustrate an embodiment of the method according to the present invention for printing an image on a printing substrate, the number of portions of fluid printing ink being produced by melting solid printing ink, which is located on the printing-ink carrier and exhibits delayed solidification, on a dot-by-dot or pixel-by-pixel basis. Shown is a section perpendicular to the direction of rotation of a printing-ink carrier. Printing-ink carrier 10 has a layer of solid printing ink 40, preferably homogenous and smooth. The printing ink is capable of being melted, softened or liquefied and solidifies in a delayed manner or with a delay (temperature hysteresis of the phase transition or temperature hysteresis of viscosity). A light source 42 of a row of VCSEL bars (not shown in this diagram) essentially parallel to the axis of rotation of printing-ink carrier 10 selectively and controllably emits laser light 44 which impinges on solid printing-ink 40. The light sources are located outside printing-ink carrier 10. Melted portions 46 of fluid printing ink are selectively and controllably produced by the thermal action of laser light 44. A pattern is produced. Due to the temperature hysteresis of the phase transition, melted portions 46 still remain liquid while the fluid printing ink already cools on the way to printing nip 414. In printing nip 414, a printing substrate 410 is pressed against the printing ink through interaction of printing-ink carrier 10 with an impression cylinder 412. In printing nip 414, portions 46 of fluid printing ink can be partially or completely transferred to printing substrate 410. Provision is made for a regeneration device 416 which makes it possible to restore a homogeneous layer of solid printing ink 40. The quantity of transferred ink lost at spots that were melted is compensated for and the surface is smoothed. In this manner, a cyclic process of imaging and regeneration is created, since solid printing ink 40 can be imaged again. The described printing method is variable and digital.

Alternatively to the situation shown in FIG. 4, the light sources can also be located inside printing-ink carrier 10. If the selective and controlled melting takes place in the immediate vicinity of printing nip 414 prior to contact with printing substrate 410, the described method can also be carried out using printing ink without solidification delay.

Figure 5:
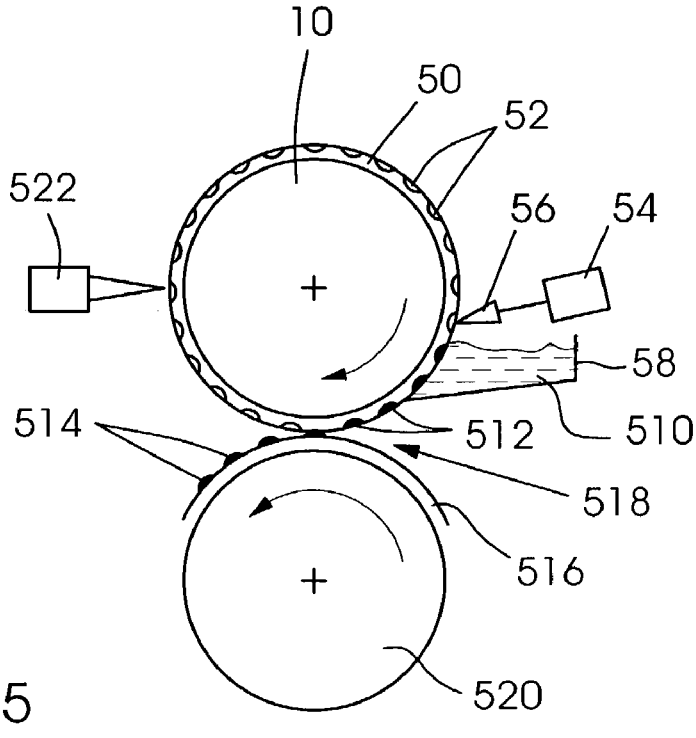
FIG. 5 is a schematic diagram to illustrate an embodiment of the method according to the present invention for printing an image on a printing substrate, the number of portions being produced by suctioning fluid printing ink into depressions on a dot-by-dot basis upon cooling of the volumes of the depressions that were heated by the energy input.

FIG. 5 is a schematic diagram to illustrate an embodiment of the method according to the present invention for printing an image on a printing substrate, the number of portions being produced by suctioning fluid printing ink into depressions on a dot-by-dot or pixel-by-pixel basis upon cooling of the volumes of the depressions that were heated by the energy input (suction pressure method). Shown is a section perpendicular to the direction of rotation of a printing-ink carrier. Printing-ink carrier 10 has a surface 50 with despressions 52. Depressions 52 form a regular, fine raster of volumes in the surface. A light source 54 of a row of VCSEL bars (not shown in this diagram) essentially parallel to the axis of rotation of the printing-ink carrier selectively and controllably emits laser light 56 which hits the volumes of the depressions 52. During the rotation of printing-ink carrier 10, surface 50 with depressions 52 passes a reservoir 58 containing fluid printing ink 510. Alternatively to the situation shown in FIG. 5, laser light source 54 or, to be more precise, the VCSEL bars can also be located inside printing-ink carrier 10. Laser light 56 is preferably radiated into the volumes of depressions 52 shortly before these volumes plunge into reservoir 58. Through the selective and controlled action of laser light 56, the air is heated differently in different depressions 52, thus producing different air displacements. When the air in the volumes of depressions 52 cools, fluid printing ink is suctioned into depressions 52 selectively and in controlled quantities. Provision is made for a stripping means (a doctor blade, a wiper, or the like) which removes excess printing ink from the raised portions of surface 50. The depressions 512 filled with printing ink reach printing nip 518 through the rotation of printing-ink carrier 10. A printing substrate 516 is pressed against surface 50 with depressions 52, in particular, with depressions 512, through interaction of printing-ink carrier 10 with an impression cylinder 520, allowing printing ink to be transferred to printing substrate 516. Transferred printing ink 514 solidifies on printing substrate 516. During the transfer of printing ink, the depressions 512 filled with printing ink are partially or completely emptied. Finally, provision is made for a cleaning device 522, which is used to prepare surface 50 for a new sequence of the steps of the printing method. The depressions 52 of surface 50 are cleaned from ink residues, so that surface 50 is reset to the starting condition for the method. Thus, the described printing method is a variable or digital method.

Figure 6:
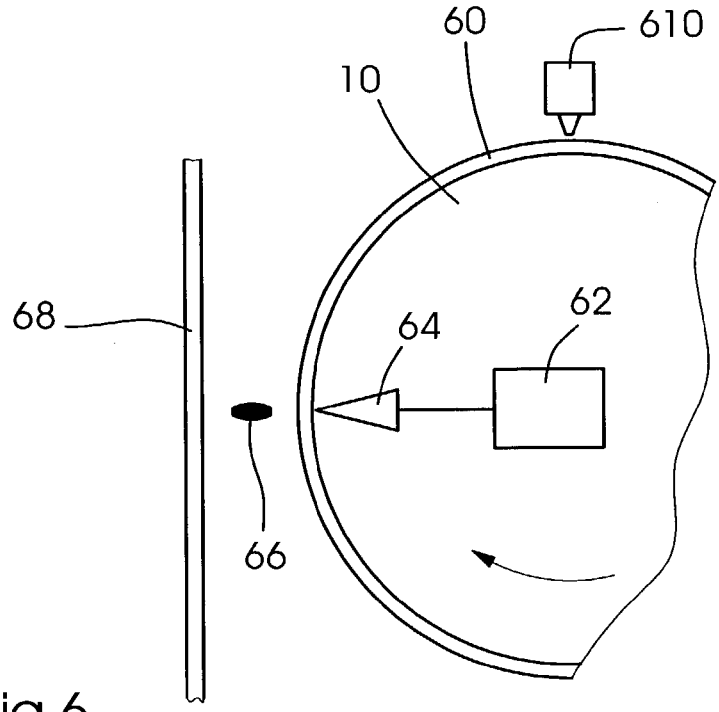
FIG. 6 is a schematic diagram to illustrate an embodiment of the method according to the present invention for printing an image on a printing substrate, the number of portions of fluid printing ink being produced by detachment from a layer of printing ink.

FIG. 6 shows a schematic diagram to illustrate an embodiment of the method according to the present invention for printing an image on a printing substrate, the number of portions of fluid printing ink being produced by detachment from a printing-ink layer 60. Shown is a section perpendicular to the direction of rotation of a printing-ink carrier. Printing-ink carrier 10 has a printing-ink layer 60 on its surface. Printing-ink layer 60 can be solid or liquid (preferred). Located inside printing-ink carrier 10, which rotates about its axis, is a laser light source 62 of a row of VCSEL bars (not shown in this diagram) which are arranged essentially parallel to the axis of rotation of the printing-ink carrier. Laser light source 62 selectively and controllably emits laser light 64. Laser light 64 impinges on printing-ink layer 60 in a region where printing-ink layer 60 is homogeneous and unpatterned. Via the light-hydraulic effect, the energy of the laser light allows detachment of portions of fluid printing ink 66, directly (in printing-ink layer 60 ) or indirectly (by conversion into acoustic energy, through production of thermal energy and the accompanying volume change in printing-ink carrier 10). A portion of fluid printing ink 66 also has an impulse, so that the portion is thrown against the surface of a printing substrate 68. Using a regeneration device 610, the surface of printing-ink layer 60 can be prepared to be used again by restoring a homogeneous and unpatterned surface. The detached quantity of ink can be replaced by applying further printing ink, during which the surface can be smoothed at the same time. Thus, the described printing method is a variable or digital method, since the restored starting condition allows the printing process to be carried out again.

Figure 7:
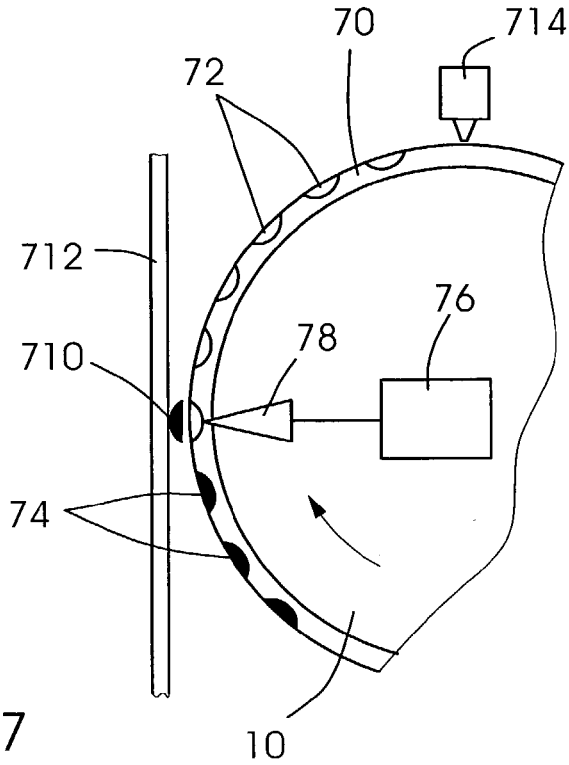
FIG. 7 is a schematic diagram to illustrate an embodiment of the method according to the present invention for printing an image on a printing substrate, the number of portions of fluid printing ink being produced by expelling from depressions in the printing-ink carrier.

FIG. 7 is a schematic diagram to illustrate an embodiment of the method according to the present invention for printing an image on a printing substrate 712, the number of portions of fluid printing ink being produced by expelling from depressions 72 in a surface 70 of a printing-ink carrier 10. Shown is a section perpendicular to the direction of rotation of printing-ink carrier 10. Printing-ink carrier 10 has a surface 70 with depressions 72, in particular depressions 74 that are filled with printing ink, and is rotatable about its axis. Located inside printing-ink carrier 10 is a laser light source 76 of a row of VCSEL bars (not shown in this diagram) which are arranged essentially parallel to the axis of rotation of the printing-ink carrier. Laser light source 76 selectively and controllably emits laser light 78. Laser light 78 impinges on surface 70 with depressions in a region where the depressions are homogeneously filled with printing ink. Energy input into a depression 74 filled with printing ink occurs such that the printing ink is pressed out, expelled or thrown out from depression 74, while printing substrate 712 contacts or touches surface 70 of printing-ink carrier 10 or is pressed against the surface. The depressions 74 filled with printing ink are partially or completely emptied in a selective and controlled manner by transferring the printing ink to printing substrate 712. As the rotation continues, depressions 72 pass a regeneration device 714. Depressions 72 are homogeneously filled with printing ink again, allowing the described printing method to be carried out repeatedly. The printing method is variable or digital.

Figure 8:
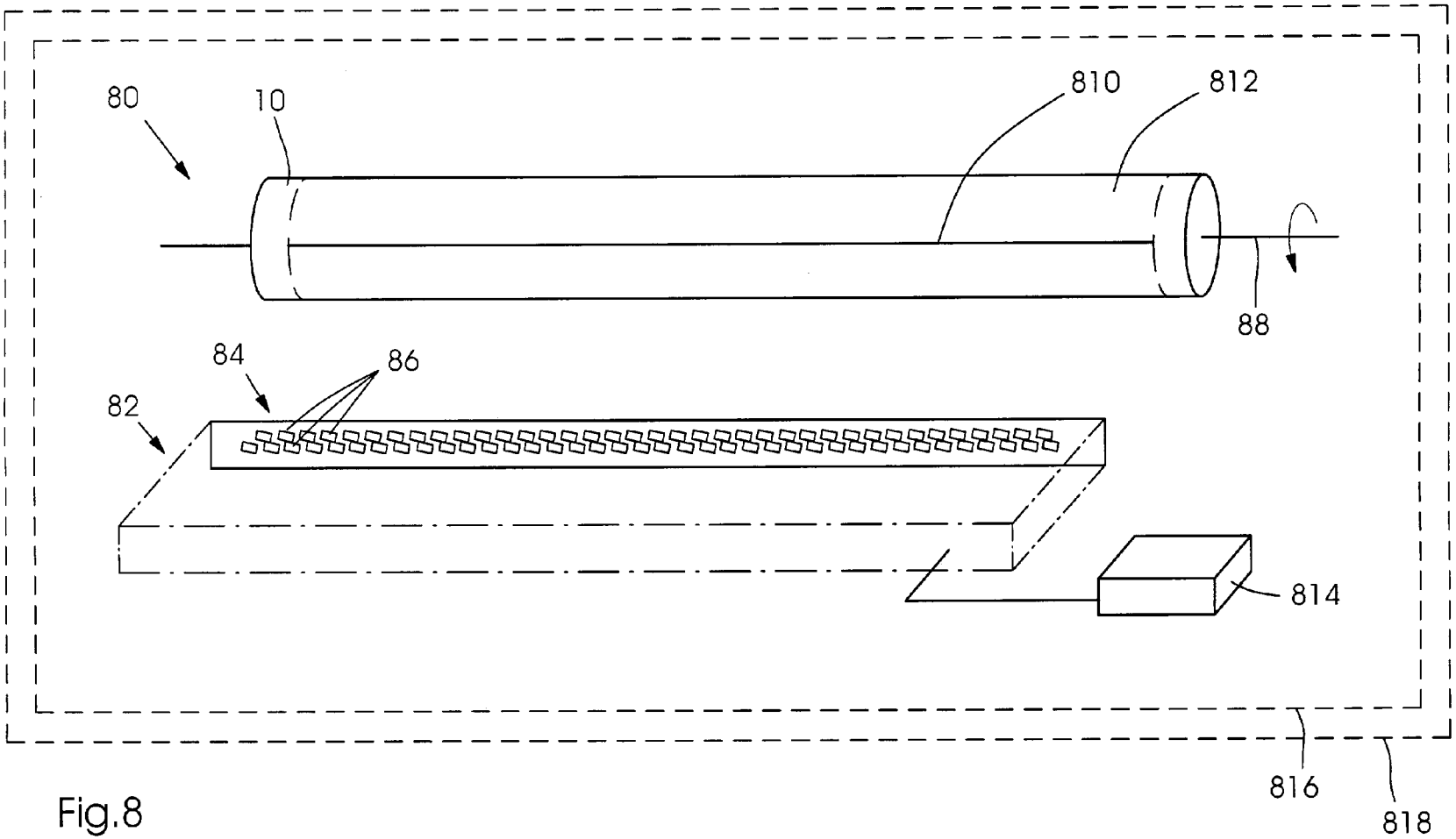
FIG. 8 is a schematic view of an embodiment of a device according to the present invention in a printing unit of a printing machine.

FIG. 8 shows an embodiment of a device 80 according to the present invention in a printing unit 816 of a printing press 818, where printing-ink carrier 10 is a cylinder, or the surface of a cylinder, or is held on a cylinder. In this embodiment, a page-wide array 84 of VCSEL light sources made up of VCSEL bars 86 in a two-dimensional arrangement of the channels or imaging beams is used for a variable printing method, such as described with reference to FIGS. 4, 5, 6 and 7. The variable printing method is preferably a digital printing process in which meltable printing ink is liquefied or softened on the printing-ink carrier using laser radiation, allowing the fluid printing ink to be transferred to the printing substrate in the liquid state (in this respect, see also FIG. 4). Each VCSEL light source or each emitter generates sufficient output power, typically 200 mW, in a beam of sufficient optical quality. The VCSEL can be driven individually. The array is made up of small modules or subarrays. The channels are dense, which means that the lines that can be written by the modules during one rotation of the cylinder produce a solid area.

FIG. 8 shows an embodiment of the device according to the present invention for inputting energy 80, including a number of individually controllable laser light sources 82 in the form of an array 84 of subarrays, the subarrays being or including VCSEL bars 86. A cylindrical printing-ink carrier 10, which is rotatable about an axis of rotation 88, is arranged opposite the individually controllable laser light sources 82. The VCSEL bars are arranged such that they are tilted by an inclination angle with respect to axis of rotation 88. Laser light sources 82 can be controlled selectively and independently of each other, in particluar in terms of optical output power, temporal tripping (power-on and power-off), and duration of the light emission. The laser light sources are connected to a control unit 814. In the case of delayed or advanced triggering, that is, when triggereing laser light sources 82 at varied points in time, the emitted laser light produces on the surface a line 810 of placed image spots according to the procedure already explained in detail with reference to FIG. 1. Array 84 is page-wide. In other words, page-wide surface area 812 of printing-ink carrier 10 is densely illuminated by the image spots of laser light sources 82, so that energy input for the creation of printing dots is possible over the complete page width. Inside printing unit 816 of printing press 818, provision is made for means (not graphically depicted here) for printing or transferring the pattern of the printing-ink carrier produced by input of energy or the portions of fluid printing ink to a printing substrate. The tripping of laser light sources 82 is coordinated with the rotation of printing-ink carrier 10. To this end, the machine control, the drive for the rotation of printing-ink carrier 10, and control unit 814 are in communication to exchange data and/or control signals.

In this connection, it should also be mentioned that it is possible to carry out an automatic calibration at regular intervals by means of control unit 814 in order to compensate for deviations of the performance curves of the VCSEL light sources on a bar or in an array that are due to ageing. Since deviations of the performance curves of individual emitters of an array rarely occur in VCSEL light sources on one bar or are insignificant, it is even possible to limit such a calibration to one emitter or a small number of emitters a subarray, respectively. The resulting measured current can be used with sufficient accuracy for all light sources.

Figure 9:
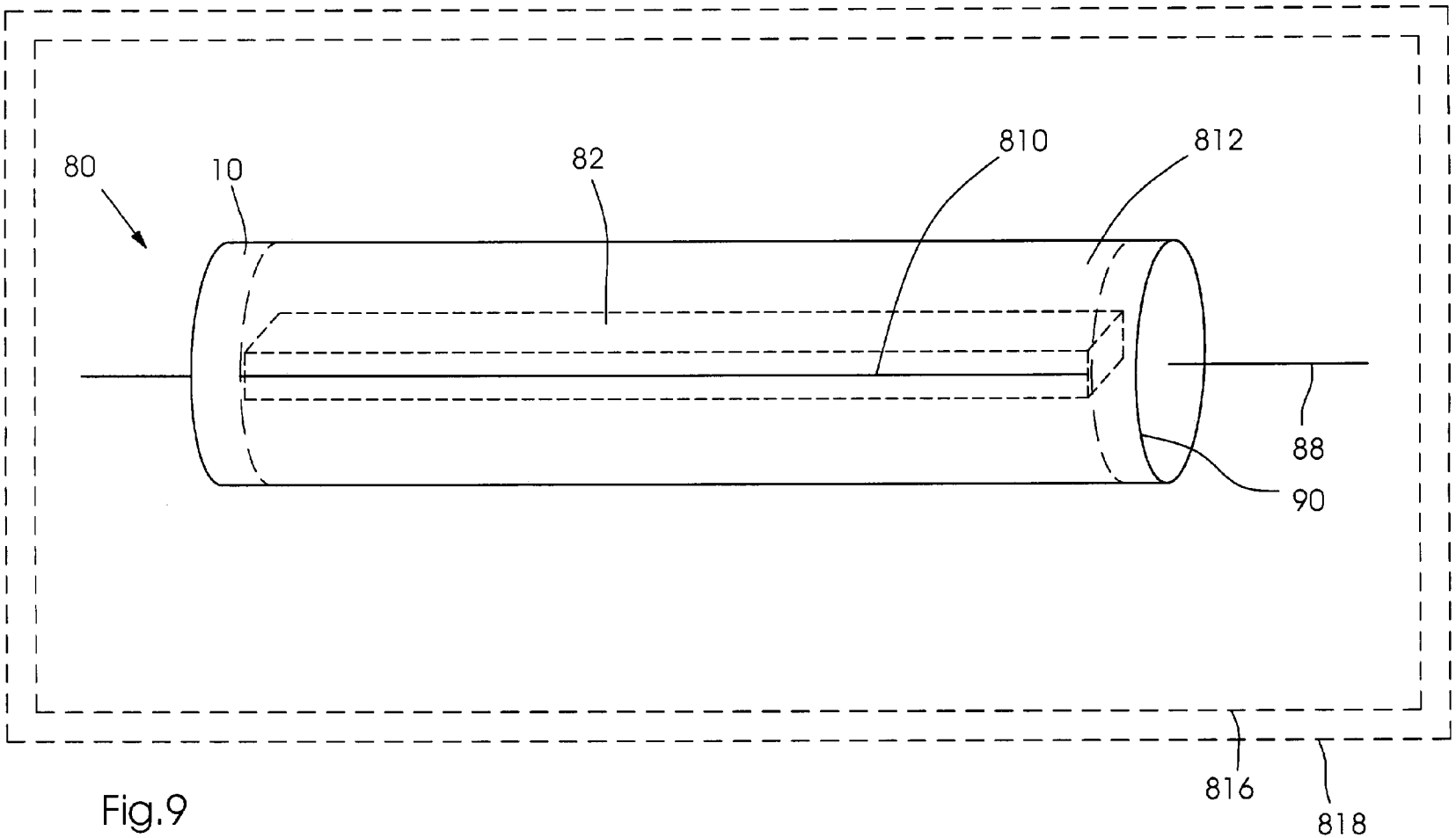
FIG. 9 is a schematic view of an embodiment of a device according to the present invention which is arranged inside the printing-ink carrier and illuminates the printing-ink carrier from its underside.

FIG. 9 shows an embodiment of a device according to the present invention which is located inside printing-ink carrier 10 and illuminates printing-ink carrier 10 from its underside 90. In this embodiment, a page-wide array 84 of VCSEL light sources made up of VCSEL bar 86 in a two-dimensional arrangement of the channels or imaging beams is used for a variable printing method, such as described with reference to FIGS. 4, 5, 6 and 7. Inside printing unit 816 of printing press 818, provision is made for means (not graphically depicted here) for printing or transferring the pattern of the printing-ink carrier produced by input of energy or the produced portions of fluid printing ink to a printing substrate. Cylindrical printing-ink carrier 10 is rotatable about an axis of rotation 88. The VCSEL bars of light sources 82 are arranged such that they are tilted by an inclination angle with respect to axis of rotation 88 of printing-ink carrier 10 (in this respect, see also FIGS. 1 and 8 ). Laser light sources 82 can be controlled selectively and independently of each other, in particluar in terms of optical output power, temporal tripping (power-on and power-off), and duration of the light emission. The laser light sources are connected to a control unit, which is not graphically depicted here. In the case of delayed or advanced triggering, that is, when tripping laser light sources 82 at varied points in time, the emitted laser light produces on the surface a line 810 of placed image spots according to the procedure already explained in detail with reference to FIG. 1. Printing-ink carrier 10 is designed such that it is transparent to the used wavelength of the laser light of the VCSEL bars so that the printing ink on the surface of printing-ink carrier 10 or the depressions of the surface of printing-ink carrier 10 are reached by the laser light. Array 84 is page-wide. In other words, page-wide surface area 812 of printing-ink carrier 10 is densely illuminated by the image spots of laser light sources 82, so that energy input for the creation of printing dots is possible over the complete page width.

List of Reference Numerals

| | |
|---|---|
| 10 | printing-ink carrier |
| 11 | surface segment of the printing-ink carrier |
| 12 | image spot |
| 13 | projected spot of an image spot |
| 14 | line |
| 15 | projection |
| 16 | axis of rotation |
| 17 | unfolding direction |
| α | inclination angle |
| 18 | normal to the axis of rotation |
| 20 | imaging module |
| 21 | first VCSEL bar |
| 22 | second VCSEL bar |
| 23 | third VCSEL bar |
| 24 | fourth VCSEL bar |
| 25 | first strip imaged by the first VCSEL bar |
| 26 | second strip imaged by the second VCSEL bar |
| 27 | third strip imaged by the third VCSEL bar |
| 28 | fourth strip imaged by the fourth VCSEL bar |
| 31 | VCSEL bar |
| 32 | first drive electronics |
| 33 | second drive electronics |
| 34 | second connecting line |
| 35 | second electronics board |
| 36 | first electronics board |
| 37 | first connecting line |
| 38 | parallel conductor tracks to VCSELs on the bar |
| 40 | solid printing ink |
| 42 | laser light source |
| 44 | laser light |
| 46 | melted portions of fluid printing ink |
| 48 | transferred printing ink |
| 410 | printing substrate |
| 412 | impression cylinder |
| 414 | printing nip |
| 416 | regeneration device |
| 50 | surface with depressions |
| 52 | depressions |
| 54 | laser light source |
| 56 | laser light |
| 58 | reservoir |
| 510 | fluid printing ink |
| 512 | depressions filled with printing ink |
| 514 | transferred printing ink |
| 516 | printing substrate |
| 518 | printing nip |
| 520 | impression cylinder |
| 522 | cleaning device |
| 60 | printing-ink layer |
| 62 | laser light source |
| 64 | laser light |
| 66 | portions of fluid printing ink |
| 68 | printing substrate |
| 610 | regeneration device |
| 70 | surface with depressions |
| 72 | depressions |
| 74 | depressions filled with printing ink |
| 76 | laser light source |
| 78 | laser light |

-continued

| List of Reference Numerals | |
|---|---|
| 710 | expelled portions of fluid printing ink |
| 712 | printing substrate |
| 714 | regeneration device |
| 80 | device for inputting energy |
| 82 | number of individually controllable laser light sources |
| 84 | array of subarrays |
| 86 | VCSEL bar |
| 88 | axis of rotation |
| 810 | line of placed image spots |
| 812 | page-wide surface area |
| 814 | control unit |
| 816 | printing unit |
| 818 | printing press |
| 90 | underside of the printing-ink carrier |

What is claimed is:

1. A device for inputting energy to a printing-ink carrier comprising:

a plurality of individually controllable laser light sources having a modular design including subarrays disposed in an array, the subarrays being VCSEL bars; and a printing-ink carrier having an axis of rotation and a surface for receiving a plurality of image spots of the laser light sources, rows of the image spots being inclined with respect to the axis of rotation when the VCSEL bars are triggered simultaneously.

2. The device as recited in claim 1 wherein the laser light sources on the VCSEL bars are arranged on intersection points of a regular Cartesian, two-dimensional grid.

3. The device as recited in claim 1 wherein an inclination angle between an unfolding direction of the row of image spots of the VCSEL bars and the axis of rotation is selected such that projected spots of the image spots on a line parallel to the axis of rotation have even spaces between neighboring spots.

4. The device as recited in claim 1 wherein the printing-ink carrier has an underside and the printing ink carrier is imaged by the laser light sources from the underside.

5. The device as recited in claim 1 wherein the VCSEL bars are staggered in at least two substantially parallel rows.

6. The device as recited in claim 1 wherein at least one VCSEL bar of the plurality of VSEL bars emits laser radiation used for inputting energy through a semiconductor substrate.

7. The device as recited in claim 1 wherein at least one VCSEL bar of the VCSEL bars includes at least one drive electronics, the drive electronic being at least partly accommodated on the substrate of the VCSEL bar and/or at least partly accommodated on a common heat sink together with the VCSEL bar and/or having a common cooling circuit with the VCSEL bar.

8. The device as recited in claim 1 wherein at least one VCSEL bar of the VCSEL bars and a part of a drive electronics for the VCSEL bar are made from one substrate.

9. The device as recited in claim 1 further comprising a surface, at least one VCSEL bar of the VCSEL bars being accommodated on the surface, the surface containing diamond and/or aluminum nitride.

10. The device as recited in claim 1 further comprising conductor tracks, at least one VCSEL bar of the VCSEL bars being contacted by the conductor tracks from two sides.

11. The device as recited claim 1 further comprising a surface, at least one VCSEL bar of the VCSEL bars being deposited on the surface, the surface having conductor tracks for controlling the individual light sources.

12. The device as recited in claim 1 wherein the array of VCSEL bars is page-wide; and projected spots of the image spots on a line parallel to the axis of rotation are dense.

13. A method for printing an image on a printing substrate comprising the steps of:

producing a plurality of portions of fluid printing ink on a printing-ink carrier by inputting energy using a plurality of image spots of an array of individually controllable VCSEL light sources; and transferring the fluid printing ink to a printing substrate, wherein the input energy is produced by a device including the array, the array including subarrays of VCSEL bars, the printing-ink carrier having an axis of rotation and a surface for receiving the plurality of image spots of the laser light sources, rows of the image spots being inclined with respect to the axis of rotation when the VCSEL bars are triggered simultaneously.

14. The method as recited in claim 13 wherein the producing step includes melting solid printing ink on the printing-ink carrier on a dot-by-dot basis.

15. The method as recited in claim 14 wherein the printing ink exhibits delayed solidification.

16. The method as recited in claim 13 wherein the producing step includes suctioning fluid printing ink into depressions on a dot-by-dot basis upon cooling of volumes of depressions heated by the input energy.

17. The method as recited in claim 13 wherein the plurality of portions of fluid printing ink are produced by expelling the fluid printing ink from depressions in the printing-ink carrier.

18. The method as recited in claim 13, wherein the plurality of portions of fluid printing ink are produced by detachment from a printing-ink layer; and wherein the transferring step occurs due to the input energy in a contact-free manner.

19. A printing press for printing an image on a printing substrate comprising:

a plurality of individually controllable laser light sources having a modular design including subarrays disposed in an array, the subarrays being VCSEL bars; and a printing-ink carrier having an axis of rotation and a surface for receiving a plurality of image spots of the laser light sources, rows of the image spots being inclined with respect to the axis of rotation when the VCSEL bars are triggered simultaneously, the light sources producing a plurality of portions of fluid printing ink on the printing-ink carrier by inputting energy using the plurality of image spots, the printing-ink carrier transferring the fluid printing ink to a printing substrate.

* * * * *